US007563073B1

(12) United States Patent
Liang

(10) Patent No.: US 7,563,073 B1
(45) Date of Patent: Jul. 21, 2009

(54) TURBINE BLADE WITH FILM COOLING SLOT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 409 days.

(21) Appl. No.: 11/545,859

(22) Filed: Oct. 10, 2006

(51) Int. Cl.
*F01D 5/18* (2006.01)

(52) U.S. Cl. ..... 416/97 R

(58) Field of Classification Search ..... 415/115, 415/116; 416/97 R
See application file for complete search history.

(56) References Cited

U.S. PATENT DOCUMENTS

| | | | | |
|---|---|---|---|---|
| 3,515,499 | A | 6/1970 | Beer et al. | |
| 3,527,543 | A | 9/1970 | Howald | |
| 4,197,443 | A | 4/1980 | Sidenstick | |
| 4,384,823 | A | 5/1983 | Graham et al. | |
| 4,653,983 | A | 3/1987 | Vehr | |
| 4,664,597 | A | 5/1987 | Auxier et al. | |
| 4,676,719 | A * | 6/1987 | Auxier et al. | 416/97 R |
| 4,684,323 | A | 8/1987 | Field | |
| 4,705,455 | A | 11/1987 | Sahm et al. | |
| 4,726,735 | A * | 2/1988 | Field et al. | 416/97 R |
| 4,738,588 | A | 4/1988 | Field | |
| 5,382,133 | A | 1/1995 | Moore et al. | |
| 6,183,199 | B1 | 2/2001 | Beeck et al. | |
| 6,287,075 | B1 | 9/2001 | Kercher | |
| 6,307,175 | B1 | 10/2001 | Blochlinger et al. | |
| 6,918,742 | B2 | 7/2005 | Liang | |
| 6,979,176 | B2 | 12/2005 | Nakamata et al. | |
| 7,008,186 | B2 | 3/2006 | Heeg et al. | |

* cited by examiner

*Primary Examiner*—Ninh H Nguyen
(74) *Attorney, Agent, or Firm*—John Ryznic

(57) ABSTRACT

A film cooling slot arrangement for a turbine blade, in which the blade includes a suction side with an impact zone on which hot and heavy particles can strike to block film cooling holes. The impact zone includes a first row of film cooling slots extending through a lower span, a middle span and an upper span of the blade. The film cooling slots in the lower span have a plurality of metering holes with axial centers at from 20 to 40 degrees from the spanwise angle of the blade. Film cooling slots in the middle span have metering holes with axial centers at from 30 to 50 degrees from the spanwise angle. And, film cooling slots in the upper span have metering holes with axial centers at from 40 to 60 degrees from the spanwise angle. A second row of film cooling slots in the impact zone and adjacent to the first row also have lower span slots, middle span slots, and upper span slots with metering holes having the axial centers of the above described angles. Each film cooling slot includes a first diffusion slot connected downstream of the metering hole and a second diffusion slot connected downstream of the first diffusion slot to produce a multiple diffusion slot for the film cooling air.

20 Claims, 4 Drawing Sheets

TURBINE BLADE WITH FILM COOLING SLOT

BACKGROUND OF THE INVENTION

1. Field of the Invention

The present invention relates generally to fluid reaction surfaces, and more specifically to a turbine blade with film cooling slots.

2. Description of the Related Art Including Information Disclosed Under 37 CFR 1.97 and 1.98

Rotor blades in a turbine of a gas turbine engine are cooled by passing cooling air through an internal cooling circuit with film cooling holes on the external surface of the airfoil to provide film cooling to the surface. A film cooling hole will open into a diffuser in order to slow the flow such that the film of cooling air develops on the airfoil surface. The cooling film provides a blanket-like effect to keep the hot gas flow from contacting the airfoil surface. The angle which the axis of the film cooling hole makes with the airfoil surface and its relation to the direction of hot gas flow over the airfoil surface at the hole exit are important design factors which influence film cooling effectiveness. The film cooling effectiveness decreases rapidly with the distance from the cooling hole exit. Maintaining a high film cooling effectiveness for as long a distance from the exit hole as possible over as large a surface area as possible is the main goal of airfoil film cooling.

It is well known in the art that engine airfoils must be cooled using a minimum amount of cooling air, since the cooling air is working fluid which has been extracted from the compressor and is therefore unavailable to perform useful work in the turbine. This bleed off from the compressor reduces the engine efficiency. Thus, it is a design challenge to provide the maximum amount of cooling with the minimum amount of cooling air.

U.S. Pat. No. 3,527,543 issued to Howald on Sep. 8, 1970 entitled COOLING OF STRUCTURAL MEMBERS PARTICULARLY FOR GAS TURBINE ENGINES shows a turbine blade with divergently tapered cooling passages of circular cross section to increase the entrainment of coolant in the boundary layer from a given passage. The passages are preferably oriented in a plane extending in the longitudinal direction or partially toward the gas flow direction to spread the coolant longitudinally upon its exit from the passage as it moves downstream.

The velocity of the air leaving the cooling passage is dependent on the ratio of its pressure at the passage inlet to the pressure of the gas stream at the passage outlet. In general, the higher the pressure ratio the higher the exit velocity. Too high an exit velocity results in the cooling air penetrating into the gas stream and being carried away without providing effective film cooling. Too low a pressure ratio will result in gas stream ingestion into the cooling passage causing a complete loss of local airfoil cooling. Total loss of airfoil cooling usually has disastrous results, and because of this a margin of safety is usually maintained. This extra pressure for the safety margin drives the design toward the high pressure ratios. Tolerance of high pressure ratios is a desirable feature of film cooling designs. Diffusion of the cooling air flow by tapering the passage, as in the Howald patent discussed above is beneficial in providing this tolerance, but the narrow diffusion angles taught therein (12 degree maximum included angle) require long passages and, therefore, thick airfoil walls to obtain the reductions in exit velocities often deemed most desirable to reduce the sensitivity of the film cooling design to pressure ratio. The same limitation exists with respect to the trapezoidally shaped diffusion passages described in U.S. Pat. No. 4,197,443 issued to Sidenstick on Apr. 8, 1908 entitled METHOD AND APPARATUS FOR FORMING DIFFUSED COOLING HOLES IN AN AIRFOIL. The maximum included diffusion angles taught therein in two mutually perpendicular planes are 7 degree and 14 degree, respectively, in order to assure that separation of the cooling fluid from the tapered walls does not occur and the cooling fluid entirely fills the passage as it exits into the hot gas stream. With such limits on the diffusing angles, only thicker airfoil walls and angling of the passages in the airfoil spanwise direction can produce wider passage outlets and smaller gaps between passages in the longitudinal direction. Wide diffusion angles would be preferred instead, but cannot be achieved using prior art teachings.

U.S. Pat. No. 4,653,983 issued to Vehr on Mar. 31, 1987 entitled CROSS-FLOW FILM COOLING PASSAGES shows a film cooling hole having a metering hole leading into a diffuser, where the diffusing portion includes a pair of adjoining surfaces which are both parallel to a central axis of the metering hole and another pair of adjoining surfaces which diverge from the central axis, the diverging pair of surfaces being located on the downstream side of the passage in order to provide an improved film cooling flow.

Axial shaped diffusion film cooling holes are normally used for the cooling of a turbine blade suction wall. The use of axial oriented film cooling holes on the suction surface is primarily for the injection of cooling air to be inline with the main stream flow of hot gas over the airfoil surface which is accelerated in the axial direction. Particles such as sand that enter the engine pass through the combustor and heated to the point of becoming a hot liquid. These hot liquid particles of sand then pass into the turbine. However, at the airfoil suction surface downstream of the leading edge region, hot and heavy particles are traveling at the combination of wheel speed (same as the turbine rotation) and also moving in the axial direction. Due to centrifugal loading, the resultant direction of travel of these particles is in the combination of radial and axial directions as shown in FIG. 1. some of the hot and heavy particles at the lower blade span will travel radially outward at a certain angle relative to the blade suction surface depending on where the hot and heavy particle is in relation to the blade span height. In this particular region, called the Impact Zone and represented by reference numeral 14 in FIG. 1, the hot and heavy particles will hit the airfoil suction surface substantially normal to the airfoil surface (represented by arrow V in FIG. 1) and solidify onto the relatively cold airfoil wall. If an axial film cooling hole is used in the impact zone 14, the particles will strike onto the airfoil surface in between the film cooling holes. With the increasing occurrence of particle strikes, the accumulated particles will plug the film cooling hole and block the flow, resulting in no film cooling on the airfoil surface from that hole.

It is therefore an object of the present invention to provide a film cooling hole arrangement on the suction side of a rotor blade that will reduce the chance of film cooling hole plugging in the impact region of the blade.

It is another object of the present invention to provide for a more effective film cooling effect on the suction side of the rotor blade in the impact region.

BRIEF SUMMARY OF THE INVENTION

The present invention is a rotor blade for a gas turbine engine with a suction side film cooling hole arrangement in the impact region of the blade. The film cooling holes include a compound angled multi-diffusion film cooling slot at a special span angle relative to the airfoil. A row of film cooling holes includes a bottom third span with the cooling holes having an exit direction of 30 degrees, a middle third have an exit direction of 40 degrees, and the tip third have an exit direction of 50 degrees in order that the ejected film cooling air follows the hot gas flow path over that particular section of the airfoil surface. The film cooling holes include a metering hole that opens into a first diffuser, and the first diffuser opens into a second diffuser before discharging the film cooling air onto the airfoil surface. The multiple angled exit directions that follow the hot gas flow path prevent hot and heavy particles from striking the airfoil wall, and the multiple diffusers in series provide for a good buildup of the coolant sub-boundary layer next to the airfoil suction surface and form an "air curtain" effect to seal the airfoil from the heavy hot particles.

DETAILED DESCRIPTION OF THE INVENTION

Figure 1:
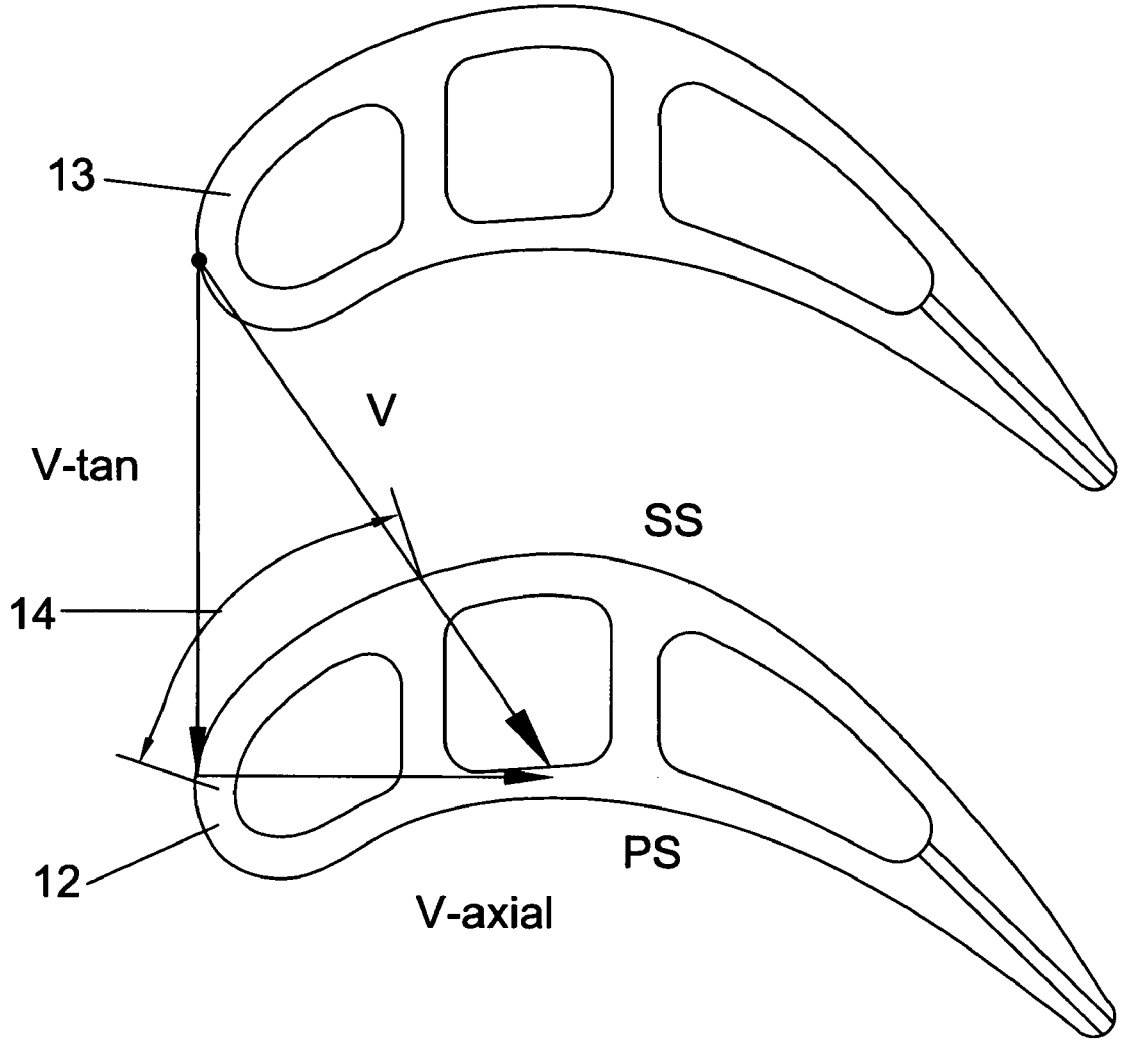
FIG. 1 shows a top view of a pair of turbine blades with the axial and tangential velocities of a hot particle path and the impact zone on the suction side.
Figure 2:
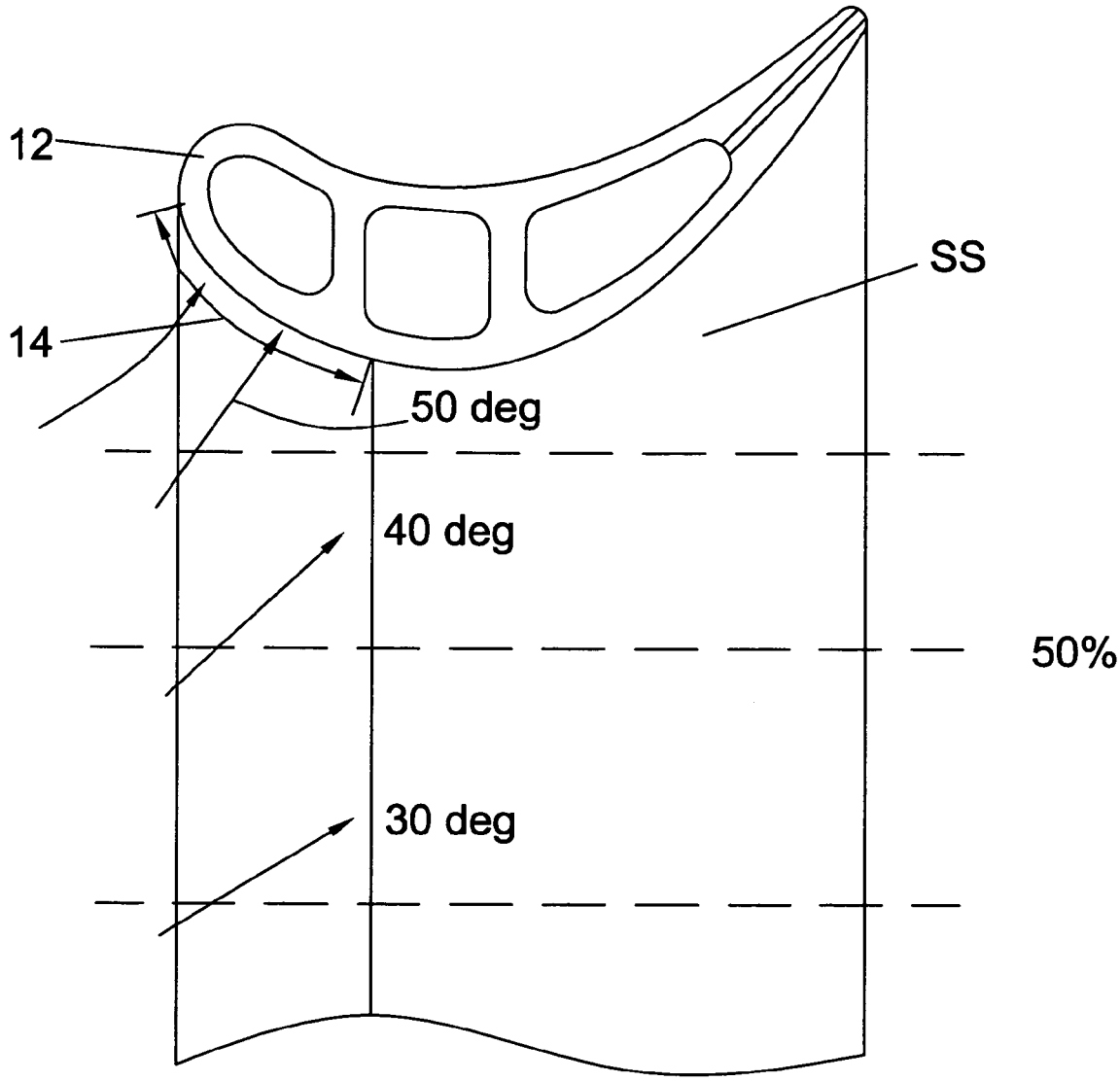
FIG. 2 shows a side view of a turbine blade with the hot particle trajectory path.

The present invention is a film cooling hole arrangement used to provide film cooling on the suction side of a rotor blade and in an impact zone located from the leading edge to a point just downstream from the leading edge region in which the airfoil is most likely to be hit by a hot and heavy particle that could plug up prior art film cooling holes. FIG. 1 shows two rotor blades 12 and 13 that form a hot gas flow passage between the suction side of one blade 12 and the pressure side of the other blade 13, a hot and heavy particle, such as a piece of sand that passes into the engine and melts within the combustor, that then passes into the turbine has a flow path V with respect to the blade 12 shown by the arrows in FIG. 1. Because the blades rotate, the flow path of a hot particle has a tangential component and an axial component. The tangential component V-tan and the axial component V-axial results in the relative flow path V with respect to the blade 12. An impact zone 14 is shown in FIG. 2. The relative flow path V of the hot particle is shown and is within 10 degrees of the normal direction to the airfoil surface in the impact zone 14.

FIG. 2 shows the suction side of the blade 12 with the impact zone 14 extending from the top toward the bottom span of the blade. The hot particle paths at three spans are shown by the arrows and the 50% span is labeled by a dashed line. At the upper span, the hot particle path is around the 50 degree angle with respect to the axial flow path. In the middle span, the hot particle flow path is around the 40 degree angle. In the bottom span, the hot particle path is around the 30 degree angle. The hot particle flow path angle increases toward the upper span due to the higher circumferential rotation speed of the blade.

Figure 3:
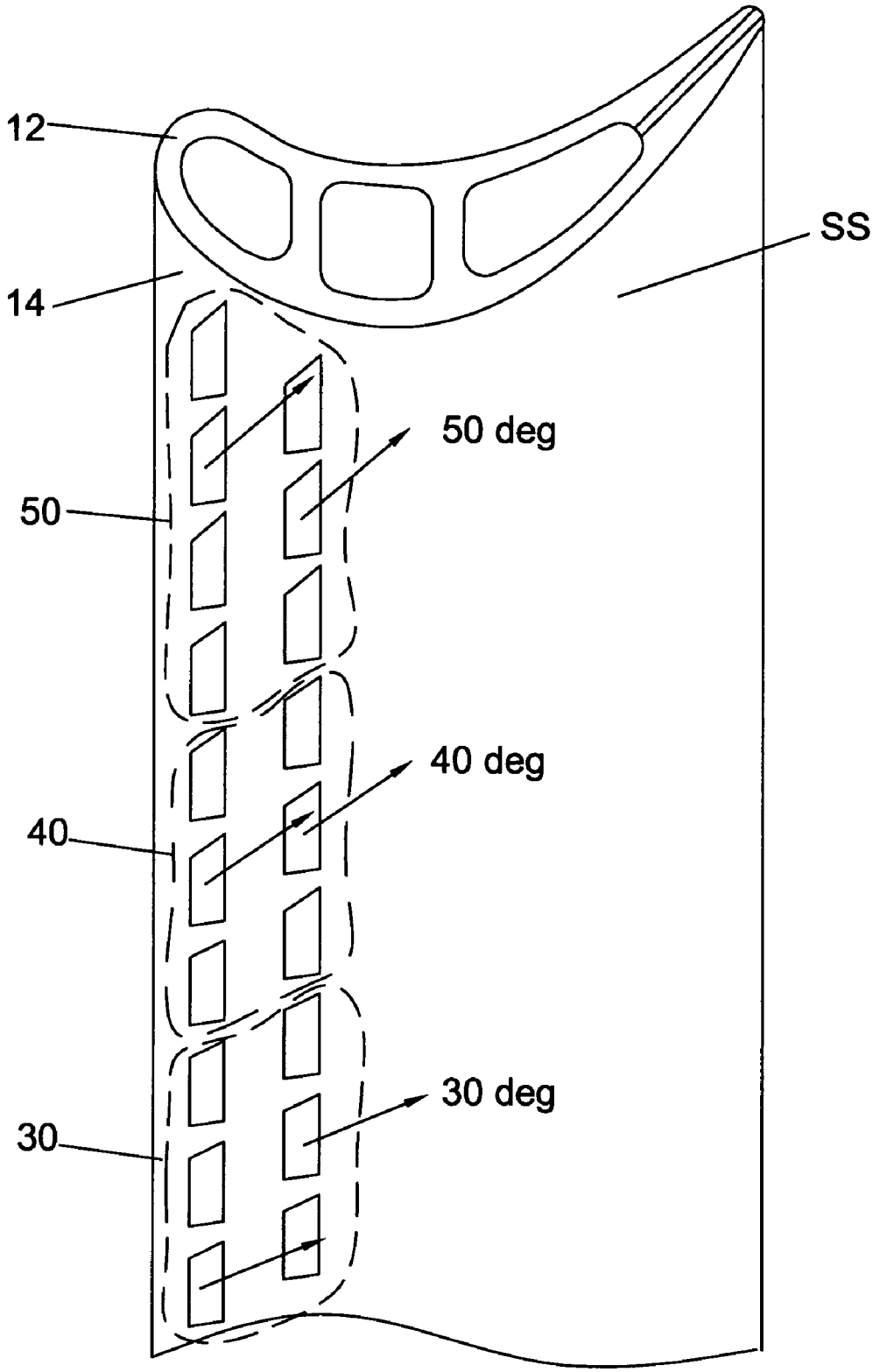
FIG. 3 shows a side view of a turbine blade suction side with the film cooling hole arrangement of the present invention.

One of the objects of the present invention is to align the flow path of the film cooling hole with the flow path that a hot particle that would enter the particle film cooling flow from the hole. FIG. 3 shows the suction side of the blade 12 with two rows of film cooling slots located in the impact zone 14 of the blade 12. The impact zone 14 is divided up into three zones and includes an upper zone 50, a middle zone 40, and a lower zone 30. The cooling slots in the upper zone 50 have a film cooling discharge angle of around 50 degrees. The cooling slots in the middle zone 40 have a film cooling discharge angle of around 40 degrees. And, the cooling slots in the lower zone 30 have a film cooling discharge angle of around 30.

Figure 4:
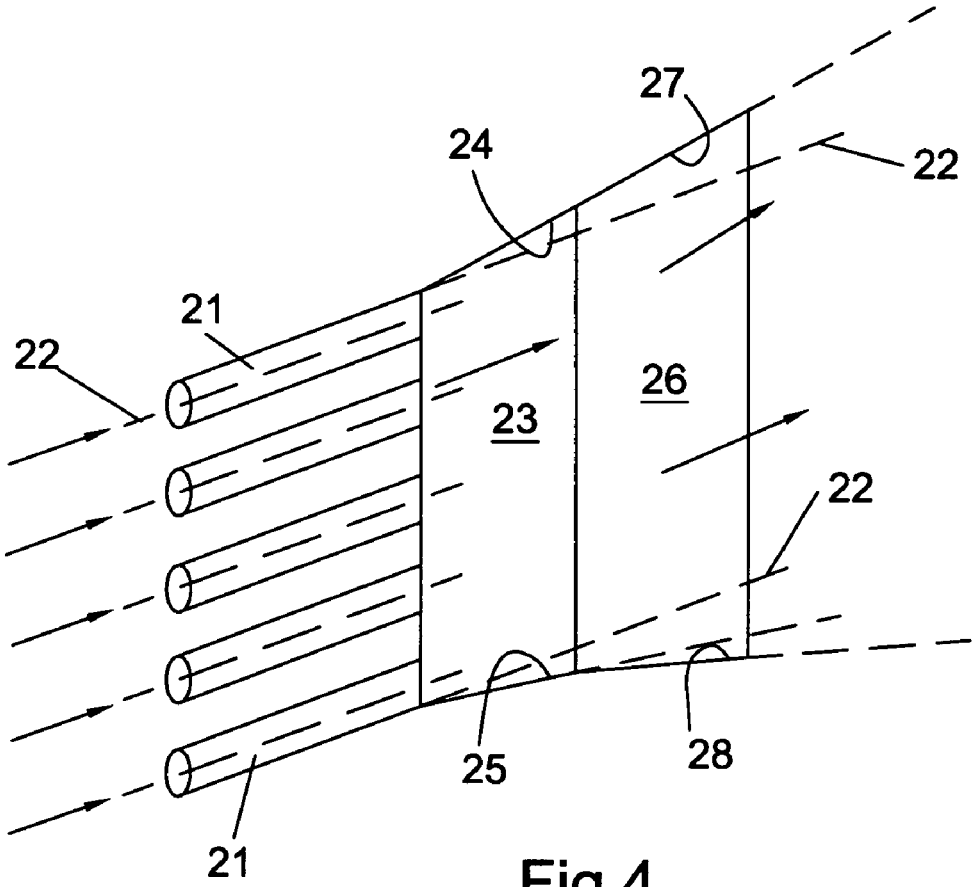
FIG. 4 shows a cross sectional side view of the multiple diffuser film cooling slot of the present invention.

FIG. 4 shows the details of one of the film cooling slots used in the three zones. A cross sectional side view is shown in the spanwise direction of the blade. A plurality of metering holes 21 leading from a cooling supply channel in the blade supply cooling air to the slot. In this embodiment, 5 metering holes 21 open into the first diffuser 23 and extend along an axial direction 22 of the metering hole. Other embodiments can have 3 or 4 metering holes opening into the slot. The first diffuser 23 has an upper surface 24 with an outward angle of 0 to 3 degrees with respect to the axial direction 22 of the metering holes 21. The first diffuser 23 also has a lower surface 25 with a radial inward slant of 7 to 13 degrees with respect to the metering hole axial direction 22. Located downstream from the first diffuser 23 is a second diffuser 26 formed by an upper surface 27 parallel to the upper surface 24 of the first diffuser 23. the second diffuser 26 has a lower surface 28 with a radial inward slant of 7 to 13 degrees with respect to the lower surface 25 of the first diffuser 23. The slots in the upper zone 50 of the blade have metering hole axis 22 of 50 degrees, the slots in the middle zone 40 have a metering hole axis of 40 degrees, and the slots in the lower zone 30 have a metering hole axis of 30 degrees.

Figure 5:
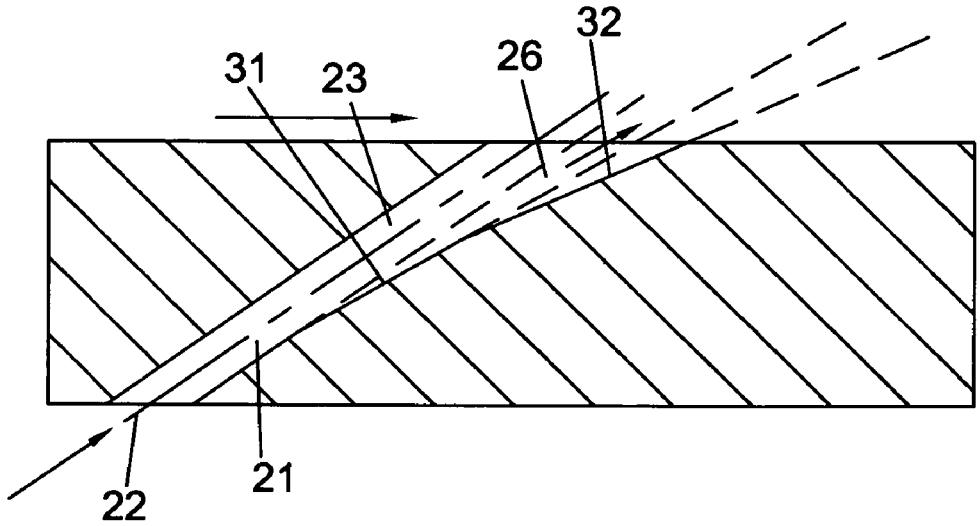
FIG. 5 shows a cross sectional top view of the multiple diffuser film cooling slot of the present invention.

The side walls of the slot shown in FIG. 5 is in the streamwise direction of the blade. Obviously, the wider opening of the cooling hole is on the hot side of the airfoil wall. The metering hole 21 with the axis 22 is shown with the first diffuser 23 and the second diffuser 26 forming the flow path. The side walls of the diffusers 23 and 26 on the upstream side are parallel to the metering hole axis 22 such that the side wall on the upstream side of the entire passage is flush. The side walls 31 and 32 on the downstream direction of the diffusers slant outward from the metering hole. The side wall of the first diffuser 31 slants 7-13 degrees with respect to the metering hole 22 axis. The side wall 32 of the second diffuser 26 slants 7-13 degrees with respect to the first diffuser side wall, forming a slant of from 14-26 degrees with respect to the metering hole axis 22.

The multiple angled and multiple diffusion film cooling slots with the special span angles relative to the airfoil provides an improved film cooling effect and reduces the likelihood that plugging of the holes will occur from hot and heavy particles. The multiple angled and multiple diffusion film cooling slots includes two portions. The first portion is the metering holes which are at a constant diameter cross section. The constant diameter holes 21 are drilled at the same orientation as the multiple angled and multiple diffusion film cooling slot.

The second portion is the multiple diffusion slot which is constructed with a 0-3 degree expansion in the spanwise radial outward direction. The multiple expansion design is incorporated into the spanwise radial inboard direction with a 7-13 degree first expansion from the end of the metering hole 21 to the diffuser 23 exit plane followed by a second expansion of 7-13 degrees from the diffuser 26 exit plane to the airfoil exterior surface. In addition, the multiple expansions are also used in the stream-wise direction of the diffusers. The first section is at expansion of 7-13 degrees from the end of the metering hole 21 to the first diffuser 23 exit plane followed by a second expansion of 7-13 degrees from the second diffuser 26 exit plane to the airfoil exterior surface. All the expansion angles are relative to the centerline axis 22 of the metering hole 21.

The multiple angled and multiple diffusion film cooling slot is subdivided into three equal groups along the blade span height. Each group is oriented at a different spanwise angle relative to the blade. The first group 30 is at a 20-40 degree spanwise angle and located from the blade lower span height to about 33% of the blade span height. The second group 40 is at 30-50 degree spanwise angle and located from blade span of 33% to about 66% blade span height. The third group 50 is at 40-60 degree spanwise angle and located from blade 66% span height to the blade tip. In another embodiment, a simplified design with a constant spanwise angle of 40-60 degrees can be used throughout the entire film row. These multiple angled and multiple diffusion film cooling slots can be EDM or laser machined into the airfoil suction side wall followed by drilling the multi-metering holes 21 into each individual diffusion slot. For the present invention, it is workable to have from 3-5 metering holes leading into one slot.

The main feature of the multiple angled and multiple diffusion film cooling slots is to allow the cooling flow discharged from each individual metering hole to be injected onto the airfoil surface at a specific spanwise angle and diffused within the diffusers. This yields a good buildup of the coolant sub-boundary layer next to the airfoil suction side surface and forms an "air curtain" effect to seal the airfoil from the hot and heavy particles. As a result, the hot particles will skip over the airfoil surface near the holes without plugging the holes.

I claim the following:

1. A film cooling hole for cooling a surface exposed to a hot gas flow, the film cooling hole comprising:

a metering hole in fluid communication with a cooling air supply channel;

a first diffusion slot located downstream from the metering hole;

a second diffusion slot located downstream from the first diffusion slot, the second diffusion slot opening onto the surface to be cooled;

the first and the second diffusion slots both have a radial outward expansion of from zero to 3 degrees with respect to the centerline of the metering hole;

the first diffusion slot has a radial inward expansion of from 7 to 13 degrees with respect to the centerline of the metering hole; and, the second diffusion slot has a radial inward expansion of from 14 to 26 degrees with respect to the centerline of the metering hole.

2. The film cooling hole of claim 1, and further comprising:

a plurality of metering holes in fluid communication with the cooling air supply channel and in fluid communication with the first diffusion slot, the centerlines of each metering hole being parallel to each other.

3. The film cooling hole of claim 1, and further comprising:

the metering hole, the first diffusion slot and the second diffusion slot each have an upstream spanwise side wall substantially flush with each other.

4. The film cooling hole of claim 1, and further comprising:

a downstream side wall of the first diffusion slot in the spanwise direction has an expansion of from 7 to 13 degrees from a centerline of the metering hole; and, a downstream side wall of the second diffusion slot in the spanwise direction has an expansion of from 14 to 26 degrees from a centerline of the metering hole.

5. A turbine blade for use in a gas turbine engine, the turbine blade having a suction side with an impact zone extending from a leading edge region, the turbine blade comprising:

a first row of film cooling slots located within the impact zone and extending from a lower span of the blade to an upper span, the first row including:

a lower span film cooling slot located in the lower span region of the row, the lower span slot connected to a metering hole with a centerline at from 20 to 40 degree spanwise angle;

a middle span film cooling hole located in the middle span region of the row, the middle span slot connected to a metering hole with a centerline at from 30 to 50 degree spanwise angle; and, an upper span film cooling hole located in the upper span region of the row, the upper span slot connected to a metering hole with a centerline at from 40 to 60 degree spanwise angle.

6. The turbine blade of claim 5, and further comprising:

the first row of film cooling slots each include a first diffusion slot downstream from the metering hole and a second diffusion slot downstream from the first diffusion slot to provide multiple diffusions to the film cooling flow from the metering hole.

7. The turbine blade of claim 5, and further comprising:

the first row of film cooling slots include a plurality of lower span film cooling slots with metering holes having the same centerline spanwise angle, a plurality of middle span film cooling slots with metering holes having the same centerline spanwise angle, and a plurality of upper span film cooling slots with metering holes having the same centerline spanwise angle.

8. The turbine blade of claim 5, and further comprising:

each of the film cooling slots is connected to a plurality of metering holes; and, each of the metering holes associated with a slot has the same centerline spanwise angle.

9. The turbine blade of claim 5, and further comprising:

a second row of film cooling slots located within the impact zone and extending adjacent to the first row of film cooling slots and extending from a lower span of the blade to an upper span, the second row including:

a lower span film cooling slot located in the lower span region of the row, the lower span slot connected to a metering hole with a centerline at from 20 to 40 degree spanwise angle;

a middle span film cooling hole located in the middle span region of the row, the middle span slot connected to a metering hole with a centerline at from 30 to 50 degree spanwise angle; and, an upper span film cooling hole located in the upper span region of the row, the upper span slot connected to a metering hole with a centerline at from 40 to 60 degree spanwise angle.

10. The turbine blade of claim 9, and further comprising:

the second row of film cooling slots each include a first diffusion slot downstream from the metering hole and a second diffusion slot downstream from the first diffusion slot to provide multiple diffusions to the film cooling flow from the metering hole.

11. The turbine blade of claim 9, and further comprising:

the first row of film cooling slots include a plurality of lower span film cooling slots with metering holes having the same centerline spanwise angle, a plurality of middle span film cooling slots with metering holes having the same centerline spanwise angle, and a plurality of upper span film cooling slots with metering holes having the same centerline spanwise angle.

12. The turbine blade of claim 9, and further comprising:

each of the film cooling slots is connected to a plurality of metering holes; and, each of the metering holes associated with a slot has the same centerline spanwise angle.

13. The turbine blade of claim 5, and further comprising:

the lower span is the lower third of the blade, the middle span is the middle third of the blade, and the upper span is the upper third of the blade.

14. The turbine blade of claim 5, and further comprising:

the metering holes associated with the slots of the lower span, the middle span and the upper span are aligned substantially with a hot and heavy particle path over the associated film cooling slot.

15. The turbine blade of claim 5, and further comprising:

the lower span metering hole is about 30 degrees;

the middle span metering hole is about 40 degrees; and, the upper span metering hole is about 50 degrees.

16. A process for cooling a turbine blade, the blade including a suction side with an impact zone with a row of film cooling holes extending from a lower span to an upper span of the blade, the process comprising the steps of:

discharging cooling air through a metering hole in the lower span at an angle of from 20 to 40 degrees with respect to the spanwise angle of the blade;

discharging cooling air through a metering hole in the middle span at an angle of from 30 to 50 degrees with respect to the spanwise angle of the blade; and, discharging cooling air through a metering hole in the upper span at an angle of from 40 to 60 degrees with respect to the spanwise angle of the blade.

17. The process for cooling a turbine blade of claim 16, and further comprising the step of:

discharging the cooling air from the metering holes into a first diffusion slot and then into a second diffusion slot.

18. The process for cooling a turbine blade of claim 17, and further comprising the step of:

discharging cooling air into the slots through a plurality of coaxial metering holes associated with each slot.

19. The process for cooling a turbine blade of claim 17, and further comprising the step of:

discharging cooling air through a second row of film cooling holes located in the impact zone and adjacent to the first row of film cooling holes.

20. The process for cooling a turbine blade of claim 19, and further comprising the steps of:

discharging cooling air through a metering hole in the lower span of the second row at an angle of from 20 to 40 degrees with respect to the spanwise angle of the blade;

discharging cooling air through a metering hole in the middle span of the second row at an angle of from 30 to 50 degrees with respect to the spanwise angle of the blade; and, discharging cooling air through a metering hole in the upper span of the second row at an angle of from 40 to 60 degrees with respect to the spanwise angle of the blade.

* * * * *